US007991315B2

(12) United States Patent
Kawamura et al.

(10) Patent No.: US 7,991,315 B2
(45) Date of Patent: Aug. 2, 2011

(54) DEVELOPING APPARATUS AND IMAGE FORMING APPARATUS INCLUDING THE SAME

(75) Inventors: Takeshi Kawamura, Mishima (JP); Shinya Yamamoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 12/144,797

(22) Filed: Jun. 24, 2008

(65) Prior Publication Data

US 2009/0003884 A1 Jan. 1, 2009

(30) Foreign Application Priority Data

Jun. 29, 2007 (JP) ..... 2007-172290

(51) Int. Cl.
*G03G 15/10* (2006.01)

(52) U.S. Cl. ..... 399/61; 399/27; 399/295

(58) Field of Classification Search ..... 399/27, 399/30, 55, 61, 252, 259, 281, 285, 295
See application file for complete search history.

(56) References Cited

U.S. PATENT DOCUMENTS

| | | | |
|---|---|---|---|
| 5,548,382 | A | 8/1996 | Koshi |
| 6,415,127 | B1 | 7/2002 | Yamamoto et al. |
| 6,738,593 | B2 | 5/2004 | Kawamura et al. |
| 6,909,869 | B2 | 6/2005 | Yamamoto et al. |
| 6,965,743 | B2 | 11/2005 | Nakagawa et al. |
| 7,006,776 | B2 | 2/2006 | Matsuzaka et al. |
| 7,031,629 | B2 | 4/2006 | Kawamura et al. |
| 7,209,690 | B2 | 4/2007 | Koyanagi et al. |
| 7,254,350 | B2 | 8/2007 | Kawamura et al. |
| 2002/0150404 | A1 | 10/2002 | Matsuzaka et al. |
| 2005/0008401 | A1 | 1/2005 | Kawamura et al. |
| 2005/0260006 | A1 | 11/2005 | Matsuda et al. |
| 2009/0003850 | A1 | 1/2009 | Yamamoto et al. |

FOREIGN PATENT DOCUMENTS

| | | | |
|---|---|---|---|
| EP | 1 091 262 | A2 | 4/2001 |
| JP | 4-234777 | A | 8/1992 |
| JP | 11-288161 | A | 10/1999 |
| JP | 2002-244414 | A | 8/2002 |
| JP | 2002-278412 | | 9/2002 |
| JP | 2003-43805 | A | 2/2003 |
| JP | 2004-177765 | A | 6/2004 |

OTHER PUBLICATIONS

Translation of JP 4234777.*
Korean Office Action dated Oct. 16, 2009 in Korean Application No. 10-2008-0061261, and an English-language translation therefor.

* cited by examiner

*Primary Examiner* — David M Gray
*Assistant Examiner* — Barnabas T Fekete
(74) *Attorney, Agent, or Firm* — Fitzpatrick, Cella, Harper & Scinto

(57) ABSTRACT

A developing apparatus, including: a developing container which has an opening portion and contains a developer; a developer carrying member which carries the developer at the opening portion; and a rotatable developer supplying member which is in contact with the developer carrying member and has a surface of a foam layer, for supplying the developer to the developer carrying member, the developer supplying member detecting a capacitance between the developer carrying member and the developer supplying member, wherein a surface aeration amount L (liter/min.) of the developer supplying member satisfies 1.8≦L.

9 Claims, 14 Drawing Sheets

PRIOR ART

PRIOR ART

PRIOR ART

DEVELOPING APPARATUS AND IMAGE FORMING APPARATUS INCLUDING THE SAME

BACKGROUND OF THE INVENTION

1. Field of the Invention

The present invention relates to a developing apparatus including a developer carrying member and a rotatable developer supplying member for supplying a developer to the developer carrying member and also relates to an image forming apparatus including the developing apparatus. The developing apparatus can be used in an electrophotographic apparatus such as a printer or a copying machine.

The device illustrated in FIG. 14 is known as a device for detecting a remaining amount of the developer (hereinafter, referred to as toner) in a developing apparatus used in an image forming apparatus such as an electrophotographic apparatus. The device is described in more detail. A magnetic mono-component developer (magnetic toner) as the developer contained in a developing container 71 is fed to a developing chamber 73 by a toner feeding member 72. In the developing chamber 73, a sleeve 75 incorporating a stationary magnet 74 and rotating in a direction indicated by the arrow of FIG. 14 is provided while facing a photosensitive drum 76. In order to coat the surface of the sleeve 75 with the toner fed to the developing chamber 73, an elastic blade 77 is provided. The sleeve 75 and the photosensitive drum 76 are separated from each other at an interval of 50 μm to 500 μm, and the surface of the sleeve 75 is coated with the toner of a thickness smaller than the interval by the elastic blade 77. The sleeve 75 is applied with a developing bias generated by superimposing an alternating voltage on a direct voltage by a developing bias power source 101, so so-called jumping development is effected between the sleeve 75 and the photosensitive drum 76.

The toner remaining amount detecting method in the above-mentioned developing apparatus 70 will now be described. An antenna 78 formed of a metal bar made of stainless steel or the like is provided in parallel with the sleeve 75. When a developing bias generated by superimposing the alternating voltage on the direct voltage is applied to the sleeve 75, the voltage depending on the capacitance between the sleeve 75 and the antenna 78 is induced by the antenna 78. Thus, there is a difference in capacitance between the sleeve 75 and the antenna 78 between the state where the space therebetween filled with the toner because the toner is not consumed and the state where the space therebetween is not filled with the toner because the toner is consumed. Accordingly, the voltage induced by the antenna 78 is different in both cases. The voltage induced by the antenna 78 is detected by a detector 102.

Generally, in the developing apparatus where the nonmagnetic mono-component developer (nonmagnetic toner) is used, the developing chamber 73 is provided with a coating member. In the case where the toner remaining amount detecting method which is performed while utilizing the variation in capacitance is adopted to the developing apparatus using the nonmagnetic toner as described above, the space in which the antenna is provided is reduced owing to the coating member. As a result, there arises such a problem in that the feeding of the toner is disturbed.

In order to solve the above-mentioned problem, as illustrated in FIG. 15, there is known a method of using a supplying member for supplying the toner to the sleeve. The supplying member 80 is formed by a urethane sponge circumferentially provided around a conductive metal supporting member 79. There is also suggested a method of detecting the toner remaining amount with the induced voltage generated as follows, in which, the sleeve 75 is applied with an alternating current when coated with the toner by the supplying member, so the voltage is induced on the conductive supporting member 79 correspondingly to the amount of the developer. (Refer to Japanese Patent Application Laid-Open No. H04-234777.)

Meanwhile, as a structure of a foam layer of a supplying member there is cited the supplying member disclosed in Japanese Patent Application Laid-Open No. H11-288161, which has the foam layer with the aeration amount of 10 to 40 cc/cm2/sec., thereby preventing the deterioration of the toner to realize to an excellent image quality. However, in the above-mentioned document, the description of the toner remaining amount detection cannot be found.

There are involved the following problems in the device for detecting the remaining amount of the developer provided in the above-mentioned image forming apparatus.

In the toner remaining amount detector in which the antenna is used as illustrated in FIG. 14, it is necessary to provide the antenna dedicated to detecting the toner remaining amount, which leads to disadvantages in space and cost. In addition, the antenna largely prevents the accurate detection of the remaining amount of the toner. This is because the remaining amount of the toner cannot be detected as long as the amount of the toner present between the antenna and the sleeve is not decreased. Specifically, the same output value is obtained in each of the cases where the toner is filled in the container sufficiently while the developing apparatus is unused and where the amount of the toner present between the antenna and the sleeve is the same as that in the unused state thereof even though the toner is consumed to some extent. In order to solve this problem, it is necessary to provide another antenna in the container.

Meanwhile, in the developer remaining amount detector disclosed in Japanese Patent Application Laid-Open No. H04-234777, it is possible to omit the dedicated antenna, thereby solving the disadvantages in space and cost. However, the detection accuracy thereof remains unsatisfactory.

SUMMARY OF THE INVENTION

It is an object of the present invention to provide a developing apparatus and an image forming apparatus which are advantageous in space and cost while omitting an antenna dedicated to detecting a capacitance in a developing container.

It is another object of the present invention to provide a developing apparatus and an image forming apparatus in which a developer supplying member is used for supplying a developer to a developer carrying member so as to detect the capacitance in the developing container.

It is still another object of the present invention to provide a developing apparatus and an image forming apparatus which are capable of accurately detecting the capacitance in the developing container.

It is yet another object of the present invention to provide a developing apparatus and an image forming apparatus in which an accuracy in detection of an amount of the developer is enhanced regardless of the remaining amount of the developer in the developing container.

Further features of the present invention will become apparent from the following description of exemplary embodiments with reference to the attached drawings.

DESCRIPTION OF THE EMBODIMENTS

Hereinafter, a developing apparatus of the present invention is described with reference to the drawings.

Figure 1:
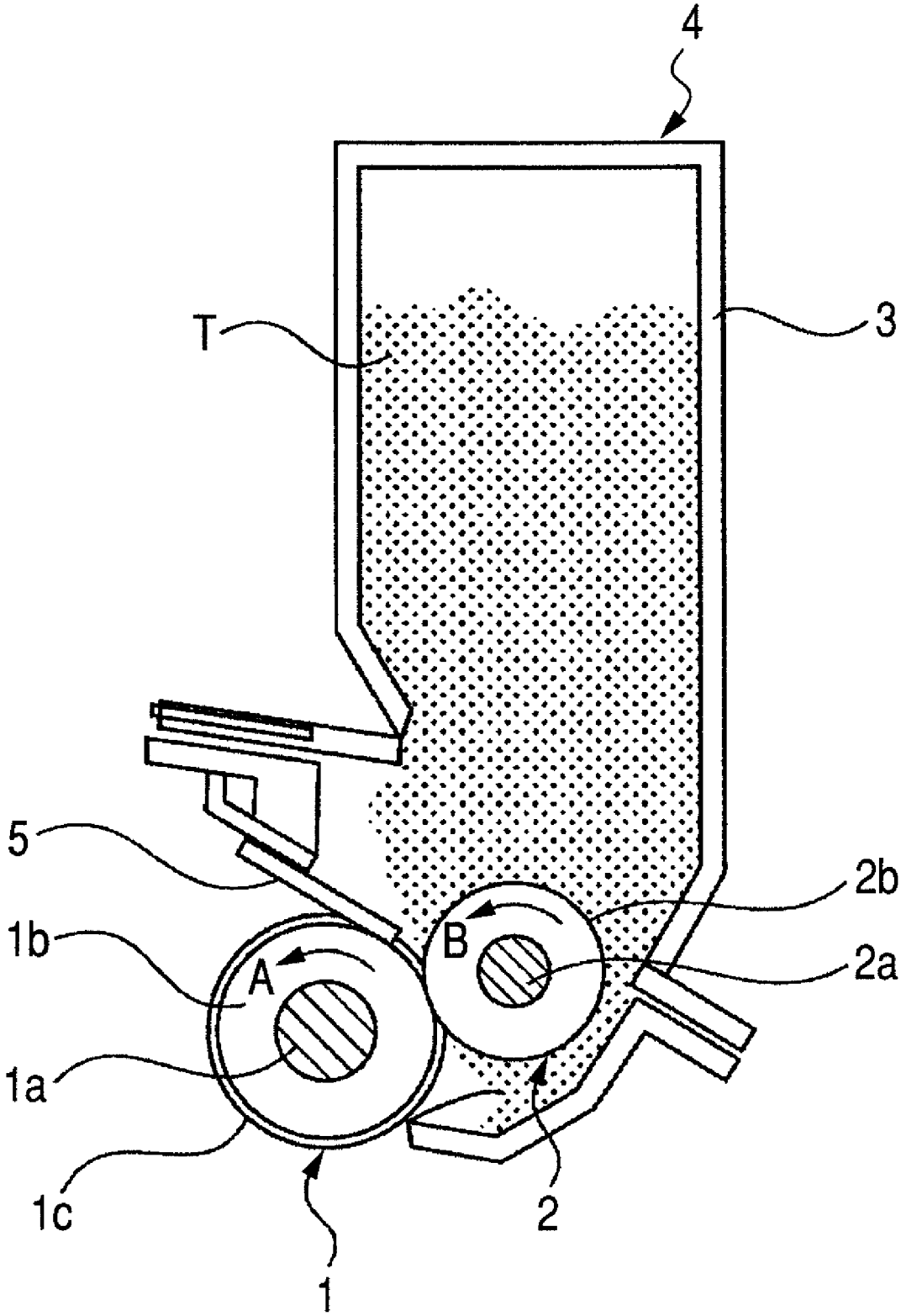
FIG. 1 is a schematic cross-sectional view illustrating an example of a developing apparatus according to the present invention.

FIG. 1 is a schematic cross-sectional view illustrating an example of the developing apparatus according to the present invention.

The developing apparatus includes a developing container 3, a developer carrying member 1, a developer supplying member 2, and a developer regulating member 5. In FIG. 1, the developing container 3 contains, as developer, toner T serving as a nonmagnetic mono-component developer. A developing roller 1 serving as the developer carrying member is disposed at an opening portion of the developing container 3 so as to be rotatably supported by the developing container 3. Further, the developing container 3 includes a supplying roller 2 serving as the developer supplying member, which rotates while in contact with the developing roller 1 for supplying the toner T to the developing roller 1, and includes the developer regulating member 5 one end of which is held in contact with the developing roller 1, for regulating the toner T supplied to the developing roller 1 so as to be formed in a thin layer. As described later, the developer supplying member also serves as a detection member for detecting the developer remaining amount in the developing container.

The negatively-charged nonmagnetic mono-component toner T is used as a developer. At the time of development, the toner T becomes negatively charged triboelectrically. The degree of compaction of the toner is 15%.

The degree of compaction of the toner was measured as follows.

As measuring apparatus, there was used a Powder Tester (manufactured by HOSOKAWA MICRON LTD.) having a digital vibration meter (DIGITAL VIBRATION METER MODEL 1332 manufactured by SHOWA SOKKI CORPORATION).

As a measurement method therefor, a 390 mesh, a 200 mesh, and a 100 mesh were stacked on a vibration table in the order of smaller mesh, that is, the 390 mesh, the 200 mesh, and the 100 mesh were stacked in this order so that the 100 mesh was placed uppermost.

A specimen (toner) of 5 g weighed accurately was placed on the 100 mesh thus set, the displacement value of the digital vibration meter is adjusted to 0.60 mm (peak-to-peak), and the vibration was applied thereto for 15 seconds. After that, mass of the specimen remaining on each of the sieves was measured so as to obtain the degree of compaction from the following equation.

The measurement samples had been left in advance for 24 hours under an environment of 23° C. and 60% RH. The measurement thereof was made under the environment of 23° C. and 60% RH.

Degree of compaction (%)=(mass of specimen remaining on 100 mesh/5 g)×100+(mass of specimen remaining on 200 mesh/5 g)×60+(mass of specimen remaining on 390 mesh/5 g)×20

In the developing apparatus 4, the opening portion of the developing container 3 was provided downward so that the dead weight of the toner T was applied onto the developing roller 1 and the supplying roller 2 disposed at the opening portion. This arrangement would be better in facilitating the developer to get into, i.e., enter, the supplying roller 2, and in enabling detection of the remaining amount of the developer in the developing container with high accuracy.

The developing roller 1 is provided with a semi-conductive elastic rubber layer 1*b* containing a conductive agent which is provided around a conductive support member 1*a*, and is rotated in the direction indicated by the arrow A of FIG. 1. Specifically, the developing roller 1 includes a cored electrode 1*a* having an outer diameter of 6 (mm) and serving as the conductive support member, the developing roller 1 being provided around the cored electrode 1*a* with the semi-conductive silicone rubber layer 1*b* containing a conductive agent. Further, the surface layer of the silicone rubber layer 1*b* is coated with an acrylic-urethane rubber layer 1*c* having a thickness of 20 (μm), so the outer diameter of the developing roller 1 is 12 (mm) in total. The developing roller 1 of the embodiments has a resistance of $1\times10^6$ (Ω).

Here, the measurement method for the resistance of the developing roller is described.

The developing roller 1 is brought into contact with the aluminum sleeve having a diameter of 30 mm at a contact load of 9.8 N. Along with the rotation of the aluminum sleeve, the developing roller 1 is driven with respect to the aluminum sleeve at 60 rpm. Next, the developing roller 1 is applied with a direct current voltage of −50 V. Then, by calculation of the difference in voltage detected at each end of the resistor of 10 kΩ provided on the side of the ground, the current is obtained, whereby the resistance of the developing roller 1 is calculated.

Note that, when the developing roller 1 has a resistance larger than $1\times10^9$ (Ω), the voltage value of the developing bias generated on the surface of the developing roller is decreased, so a direct electric field in the developing region is reduced, which leads to reduction in developing efficiency. As a result, there arises a problem of a decrease in image density. Therefore, it is better to set the developing roller 1 to have a resistance equal to or less than $1\times10^9$ (Ω).

The supplying roller 2 serving as a developer supplying roller member and developer detecting member includes a conductive support member 2*a* and a foam layer 2*b* supported by the conductive support member. Specifically, the supplying roller 2 includes the cored electrode 2*a* having an outer diameter of 5 (mm) and serving as the conductive support member, and is provided around the cored electrode 2*a* with the urethane foam layer 2*b* which is a foam layer constituted by an open-cell foam (open cells) which are formed of cells interconnected with one another, and is rotated in the direction indicated by the arrow B of FIG. 1. The entire outer diameter of the supplying roller 2 including the urethane foam layer 2*b* is 13 (mm). When the surface layer of the urethane is formed with the open-cell foam, a large amount of toner can get into, i.e., enter, the supplying roller. As a result, it is possible to enhance the accuracy in the toner remaining amount detection.

Incidentally, the supplying roller 2 of the embodiments has a resistance of $1\times10^9$ (Ω).

Here, the measurement method for the resistance of the supplying roller is described.

The supplying roller 2 is brought into contact with the aluminum sleeve having a diameter of 30 mm so as to have an inroad amount of 1.5 mm as described later. Along with the rotation of the aluminum sleeve, the supplying roller 2 is driven with respect to the aluminum sleeve at 30 rpm. Next, the developing roller 1 is applied with a direct current voltage of −50 V. Then, by calculation of the difference in voltage detected at each end of a resistor of 10 KΩ provided on the side of the ground, the current is obtained, whereby the resistance of the supplying roller 2 is calculated.

The supplying roller 2 was set to have the average surface cell diameter of 50 μm to 1000 μm.

Here, the cell diameter refers to the average diameter of the arbitrary cross sections of the foamed cells. The area of the largest foamed cell is measured based on enlarged images of the arbitrary cross sections, and then the area thus measured is converted into the corresponding diameter of the complete round. In this manner, the maximum cell diameter is obtained. The cell diameter is a mean value obtained by a similar conversion of the area of each of the residual cells thereinto, which is performed after deleting as a noise the foamed cells having a diameter equal to or smaller than a half of the maximum cell diameter.

Further, as the supplying roller 2, there was used one having the surface aeration amount of 1.8 (liter/min.) or more.

The "surface aeration amount" of the supplying roller 2 of the embodiments will now be described in detail.

In this specification, the "aeration amount" is defined so as to perform smooth discharge and absorption of the toner outside and inside the supplying roller and to set the inside and outside of the supplying roller equilibrium with each other. The discharge and absorption of the toner, which is formed into the powder and granular material by being mixed with air, are performed via the "surface layer" of the supplying roller, so it is important to define the "aeration amount of air which passes through surface layer" itself.

Figure 2:
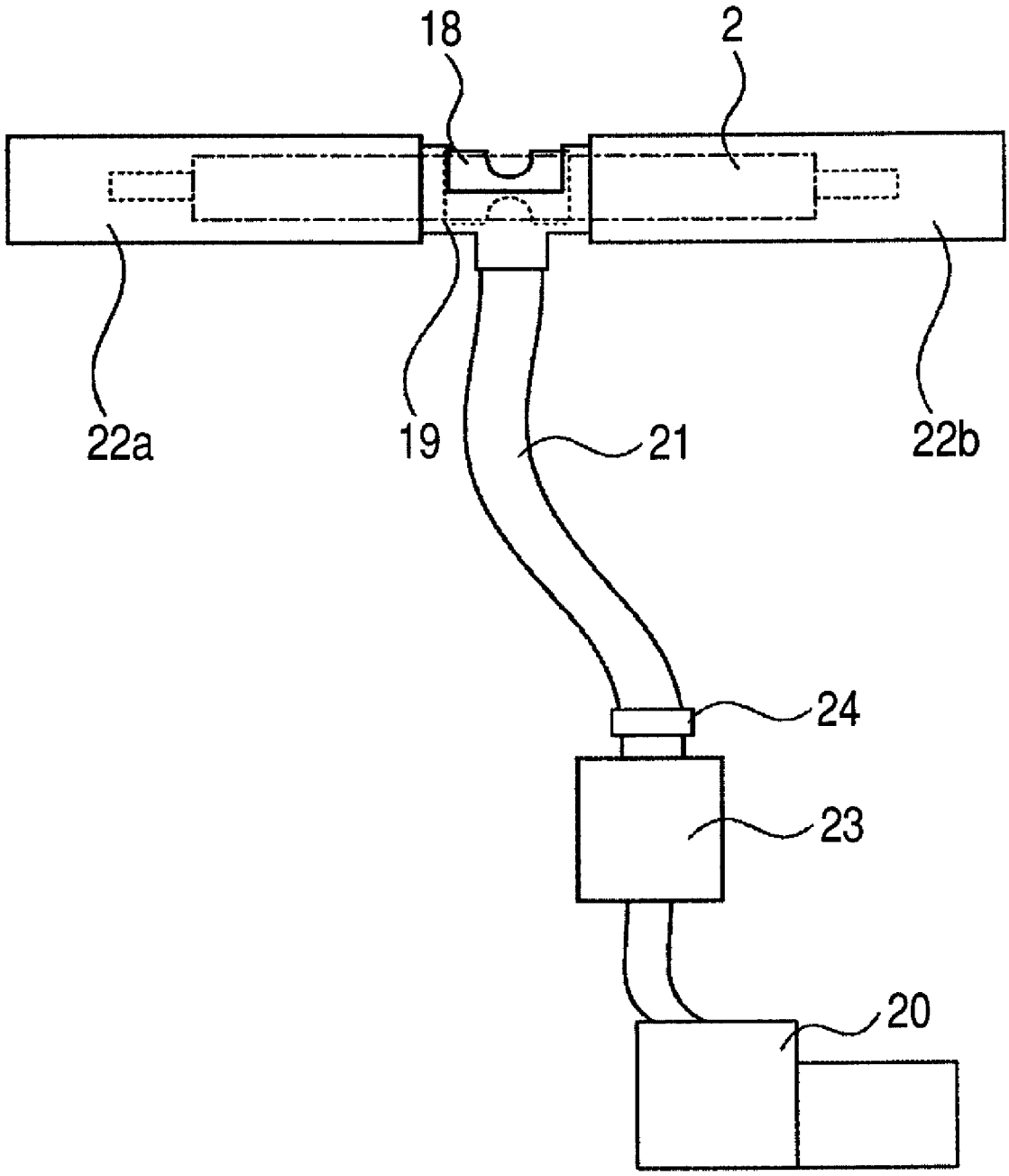
FIG. 2 is a view illustrating a measurement method for a "surface aeration amount".

FIG. 2 illustrates a measurement method for the "surface aeration amount".

Figure 3:
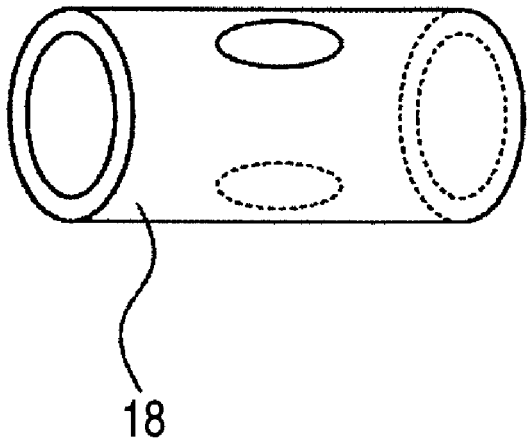
FIG. 3 is a view of a jig used in a measurement of the aeration amount.

First, the supplying roller 2 of the embodiments is inserted into a measurement jig 18 as illustrated in FIG. 3. The measurement jig 18 of FIG. 3 is formed by providing a hollow cylinder with through-holes each having a diameter of 10 (mm), the center axis of the through-holes and the cylinder axis being orthogonal to each other. The hollow cylinder is used which has an inner diameter smaller by 1 mm than the outer diameter of the supplying roller to be measured. This is because the gap between the inner surface of the cylinder of the measurement jig 18 and the supplying roller to be measured should be eliminated. The supplying roller 2 of the embodiments has an outer diameter of 13 (mm), and the measurement jig 18 has an inner diameter of 12 (mm).

Figure 4:
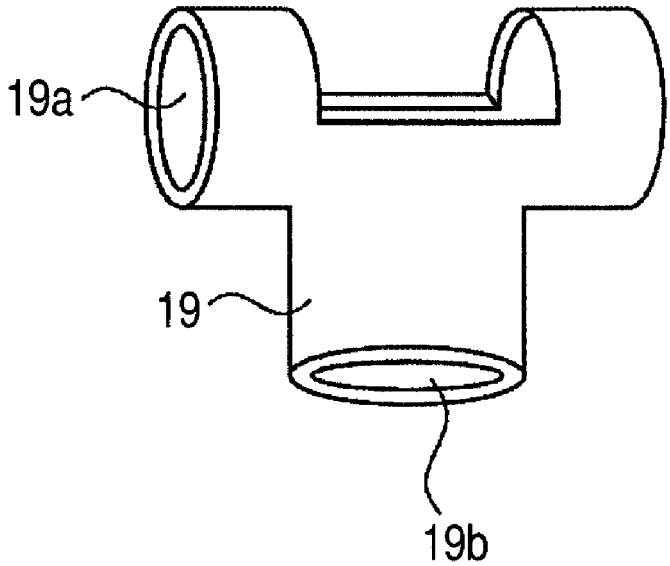
FIG. 4 is a view of an aeration holder used in the measurement of the aeration amount.

The measurement jig 18 into which the supplying roller 2 is inserted is attached to an aeration holder 19 as illustrated in FIG. 4. The aeration holder 19 is formed in a T-shaped configuration which is obtained by connecting a connection pipe 19*b* for attaching thereto an aeration tube 21 communicating with a decompression pump 20 to the side surface of the hollow cylinder 19*a,* the opposite side to the portion to which the connection pipe 19*b* is connected being largely cut off. An inner diameter of the connection pipe 19*b* is set to be larger than the through-hole of the measurement jug 18. The connection pipe 19*b* in the embodiments has an inner diameter of 12 (mm). The inner diameter of the hollow cylinder 19*a* of the aeration holder 19 is substantially the same size as the outer diameter of the measurement jig 18, with the measurement jig 18 capable of being inserted into the hollow cylinder 19*a*. As illustrated in FIG. 2, the measurement device is set such that one of the through-holes of the measurement jig 18 is entirely exposed to the cut-off portion formed on the hollow cylinder 19*a,* and that the other through-hole is faced with the inner diameter of the connection pipe 19*b* substantially diametrically.

As illustrated in FIG. 2, to the left and right of the hollow cylinder 19*a* of the aeration holder 19, acrylic pipes 22*a* and 22*b* are respectively provided, each of which is connected to the hollow cylinder 19*a* and each end of which is closed. The supplying roller 2 protruding from the left and right of the measurement jig 18 is accommodated within the acrylic pipes 22*a* and 22*b*.

At the midway of the aeration tube 21, there are provided a flowmeter 23 (KZ Type Air Permeability Tester: manufactured by DAIEI KAGAKU SEIKI MFG. co., ltd.) and a differential pressure control valve 24.

When air inside the aeration tube 21 is discharged by the decompression pump 20, the measurement jig 18, the aeration holder 19, the aeration tube 21, and the acrylic pipes 22*a* and 22*b* are sealed by tape or grease such that air does not flow thereinto from the holes except the exposed through-hole of the measurement jig 18.

The "surface aeration amount" is measured as follows. First, in the measurement device of FIG. 2, the decompression pump 20 is actuated while the supplying roller 2 is not provided, the flowmeter 23 is adjusted by using the differential pressure control valve 24 so as to stably indicate a measurement value of 10.8 (liter/min.). After that, the supplying roller 2 to be measured is provided therewith to be carefully sealed as described above. Under the same exhaust condition, the measurement value of the flowmeter 23 is measured as the "surface aeration amount". As a matter of course, the measurement value of the "surface aeration amount" to be adopted is obtained at the point in time the measurement value of the flowmeter 23 is sufficiently stabilized.

The airflow passing through the supplying roller 2 flows thereinto through a portion of the surface of the urethane foam layer 2*b,* the portion being provided to the exposed through-hole of the measurement jig 18. Then, the airflow passes through the inside of the urethane foam layer 2*b* to flow out through another portion of the surface of the urethane foam layer 2*b*, the another portion being provided to the other through-hole of the measurement jig 18.

The surface of the urethane foam layer 2*b* of the supplying roller 2 is generally different in properties from the inside of the urethane foam layer 2*b* in many cases. For example, in the case where the supplying roller 2 is subjected to foam formation in a die, the skin layer in which the opening ratio of the cells in the surface is different from that of the cells inside thereof appears on the surface of the urethane foam layer 2*b* in some cases. Further, the surface of the urethane foam layer 2*b* may be intentionally provided with protrusions and recesses instead of being formed to be mere a cylindrical surface. The toner particle fluid which gets into and out of the urethane foam layer 2*b* is influenced by the condition of the surface in some cases. For example, with only the measurement of bulk aeration amount performed according to JIS-L1096, the movement of the toner cannot be accurately observed. That is, the aeration amount of the supplying roller of the embodiments cannot be defined according to the aeration amount defined by JIS-L1096. Therefore, for the supplying roller of the embodiments, there is adopted the measurement method for the aeration amount as described above by which the air flows in and out through the surface of the urethane foam layer 2*b*, so values obtained thereby were used as main parameters with reference to which the equilibrium state (or state proximate thereto) of the toner formed into powder and granular material is defined. That is, the inventors of the present invention found that the parameters are important.

The developing roller 1 and the supplying roller 2 rotate in the directions of the arrows A and B of FIG. 1, respectively. The distance between the rotation centers is set to 11 (mm). The hardness of the urethane foam layer 2*b* is sufficiently lower than those of the silicone rubber layer 1*b* and the acrylic-urethane rubber layer 1*c*, so the urethane foam layer 2*b* is held in contact with the surface of the developing roller 1 while being deformed by 1.5 (mm) at maximum. The maximum deformation amount is obtained by measuring the maximum distance between the position of the surface of the urethane foam layer 2*b* in the case where the urethane foam layer 2*b* is not held in contact with the developing roller 1 and the position of the surface of the urethane foam layer 2*b* in the case where the urethane foam layer 2*b* is held in contact with the developing roller 1 to be deformed in the normal use state. The maximum deformation amount is referred to as an inroad amount of the developing roller 1 with respect to the supplying roller 2.

The developing roller 1 rotates at the rotating speed of 130 (rpm), and the supplying roller 2 rotates at the rotating speed of 100 (rpm). According to the rotations of the developing roller 1 and the supplying roller 2, the urethane foam layer 2*b* is deformed by the developing roller 1 at the contact portion therebetween. In this case, the toner T retained in the surface layer of or inside the urethane foam layer 2*b* of the developing roller 2 is discharged through the surface layer of the urethane foam layer 2*b* by deformation of the urethane foam layer 2*b*, so a part of the discharged toner T is transferred to the surface of the developing roller 1. The toner T transferred to the surface of the developing roller 1 is uniformly regulated on the developing roller 1 by the regulating blade 5 serving as a developer regulating member provided downstream with respect to the contact portion in the rotational direction of the developing roller 1 while in contact therewith. In the above-mentioned process, the toner T is rubbed at the contact portion between the developing roller 1 and the supplying roller 2, or the regulating portion between the developing roller 1 and the regulating blade 5, thereby obtaining a triboelectrification charge (negative charge in the embodiments). Further, as illustrated in FIG. 1, the toner remaining on the developing roller 1 rotates at the contact portion between the developing roller 1 and the supplying roller 2 in a direction opposite thereto, thereby being scraped off to be removed at the contact portion by the supplying roller 2. When the deformation of the urethane foam layer 2*b* caused by the developing roller 1 is released after passing the contact portion therebetween, the toner is absorbed in the urethane foam layer 2*b*.

Figure 5A:
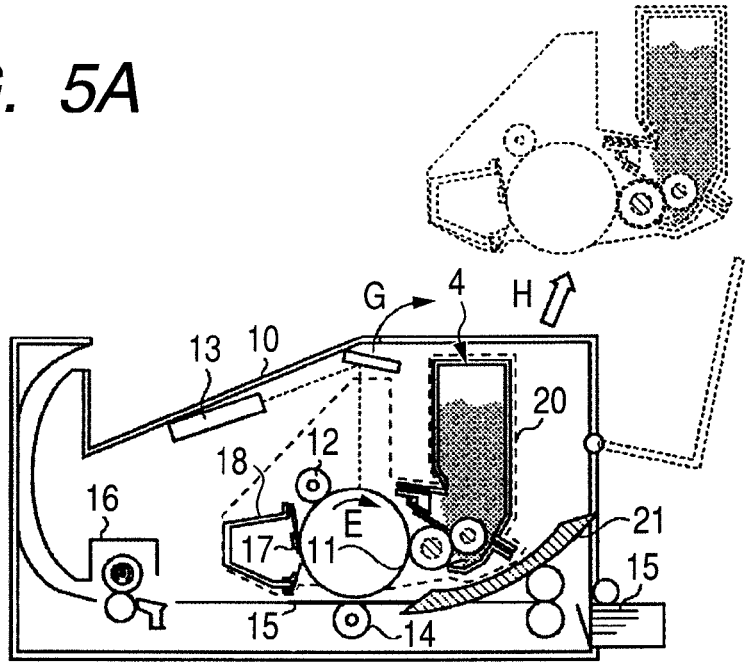
FIG. 5A is a schematic cross-sectional view illustrating an image forming apparatus including the developing apparatus according to the present invention.
Figure 5B:
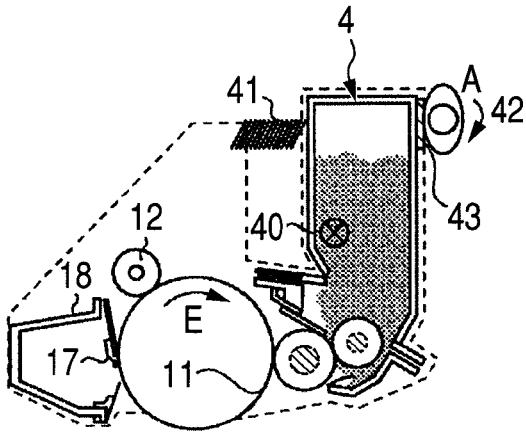
FIG. 5B is a view illustrating a contact state in the developing apparatus.
Figure 5C:
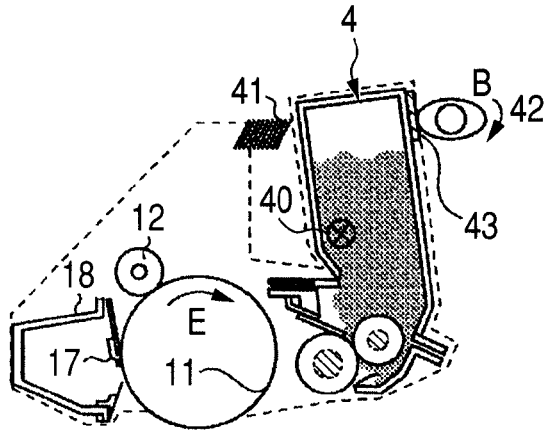
FIG. 5C is a view illustrating a separated state in the developing apparatus.

Next, with reference to FIGS. 5A, 5B, and 5C, the operation to be performed is described in the case of mounting the developing apparatus of the embodiments to the image forming apparatus. FIG. 5A is a schematic cross-sectional view illustrating an image forming apparatus 10 including the developing apparatus according to the present invention.

FIG. 5A illustrates a photosensitive drum 11 serving as an image bearing member and rotating in the direction indicated by the arrow E. First, the photosensitive drum 11 is uniformly and negatively charged by a charging roller 12. After that, the photosensitive drum 11 is exposed by a laser beam emitted from a laser optical device 13 serving as an exposure means, so an electrostatic latent image is formed on the surface thereof.

The electrostatic latent image is developed by the developing apparatus 4 to be visualized as a toner image. In the embodiments, the toner adheres to the exposed portion of the photosensitive drum 11 to be reversally developed.

The visualized toner image on the photosensitive drum 11 is transferred by a transfer roller 14 to a recording medium 15 serving as a transfer member. The untransferred toner remaining on the photosensitive drum 11 is scraped off by a cleaning blade 17 serving as a cleaning member so as to be contained in a waste toner container 18. The cleaned photosensitive drum 11 repetitively performs the above-mentioned operation to form images. Meanwhile, the recording medium 15 to which the toner image is transferred is, after the toner image is permanently fixed thereto by a fixing apparatus 16, discharged to outside the image forming apparatus.

In the embodiments, the developing apparatus 4 is provided as a cartridge 20 collectively constituted by the photosensitive drum 11, the charging roller 12, the cleaning blade 17, and the waste toner container 18. The cartridge 20 is drawn out along a guide 21 by a user in the direction indicated by the arrow H of FIG. 5A by opening an opening-closing window in the direction indicated by the arrow G of FIG. 5A. In this manner, the cartridge 20 is detachable from the main body of the image forming apparatus.

In the embodiments, a direct voltage of −1000 V is applied to the charging roller 12, so the surface of the photosensitive drum 11 is charged at approximately −500 V. The potential therebetween is referred to as a dark potential Vd. For a predetermined period of time until the potential Vd of the photosensitive drum 11 is stabilized, as illustrated in FIG. 5C, the developing apparatus 4 is maintained in the state where the photosensitive drum 11 and the developing roller 1 are separated from each other. A separation cam 42 is provided in the main body of the image forming apparatus so as to be rotated by a drive unit and a drive transmission unit (not shown) which are provided in the main body of the image forming apparatus. At a separated position B, the separation cam 42 presses a predetermined position on the rear surface of the developing apparatus 4. As a result, the following state is realized where, in a pre-rotation period and a post-rotation period, the separation cam 42 is maintained in the state where the photosensitive drum 11 and the developing roller 1 are separated from each other.

The developing apparatus includes a force receiving portion 43 for receiving the force by which the developing container is movable between a first position at which a developing operation is performed by the developing roller and a second position at which a developing operation is not performed. The force receiving portion 43 is provided at the predetermined position on the rear surface of the developing apparatus 4 of the cartridge. The force receiving portion 43 exhibits performances such as surface smoothness required when the separation cam 42 rotates while in contact therewith and hardness with which the force receiving portion 43 is prevented from being deformed even in a separated state where the largest force is applied thereto in the embodiments.

By the rotational operation of the separation cam 42, the cam surface of the separation cam 42 presses the force receiving portion 43 of the cartridge, so the developing apparatus 4 rotates about a rocking center 40 serving as a rotational axis to overcome the reaction force of a pressing spring 41 which is provided between the developing apparatus 4 and the waste toner container 18. According to the rocking of the developing apparatus 4, the developing roller 1 is moved from the contact portion (FIG. 5B) to the separated position (FIG. 5C) with respect to the photosensitive drum 11.

The position at which the developing apparatus has a posture with which the developing roller 1 is held in contact with the photosensitive drum 11 is referred to as the first position (development position) and the position at which the developing apparatus has a posture with which the developing roller 1 is separated from the photosensitive drum 11 is referred to as the second position (non-development position). As a matter of course, the developing operation is not performed at the second position.

After the potential Vd of the photosensitive drum 11 is stabilized, the photosensitive drum 11 is exposed by a laser beam emitted from a laser optical device 13 serving as an exposure means. As a result, the electrostatic latent image is formed on the surface of the photosensitive drum 11. The surface potential of the exposed portion is approximately −100 V. The potential is referred to as a light potential Vl. Further, at a predetermined timing, the drive unit and the drive transmission unit (not shown) start the rotational drive of the developing roller 1 and the supplying roller 2, whereby the developing roller 1 and the supplying roller 2 is prepared for the following development of the electrostatic latent image. Prior to the development, the developing apparatus has been moved from the second position to the first position. Therefore, the first position of the developing apparatus is a position at which the developing roller 1 and the photosensitive drum 11 are brought into contact with each other so as to develop the electrostatic latent image formed on the photosensitive drum 11.

For example, as illustrated in FIG. 5B, the separation cam 42 is rotated by the driving means provided in the main body of the image forming apparatus such that the developing apparatus is positioned at a separated position (non-development position) A. At the separated position A, the force is released with which the force receiving portion 43 on the rear surface of the developing apparatus. Accordingly, with the force of the pressing spring 41 provided between the developing apparatus 4 and the waste toner container 18, the developing apparatus 4 rotates about the rocking center 40 serving as a rotational axis, so the photosensitive drum 11 is brought into contact with the developing roller 1 (FIG. 5B). At this time, the developing roller 1 is applied with a direct current of −300 V as a developing bias at a predetermined timing.

After the completion of the development of the electrostatic latent image, that is, during the post-rotation of the photosensitive drum 11, the separation cam 42 is again rotated to the separated position B. Accordingly, the separation cam 42 presses the force receiving portion 43 on the rear surface of the developing apparatus 4, so the developing apparatus 4 rotates about the rocking center 40 serving as a rotational axis to overcome the reaction force of a pressing spring 41 which is provided between the developing apparatus 4 and the waste toner container 18. As a result, the developing roller 1 is separated from the photosensitive drum 11. That is, the developing apparatus 4 is again moved to the second position.

Simultaneously therewith, the rotational drive of the developing roller 1 and the supplying roller 2 is stopped so as to stop the application of the developing bias to the developing roller 1.

In the embodiments, at the second position (FIG. 5C) at which the developing roller 1 is separated from the photosensitive drum 11, the capacitance between the developing roller and the supplying roller is detectable, so the toner remaining amount of the developing apparatus 4 is detected there.

Figure 6:
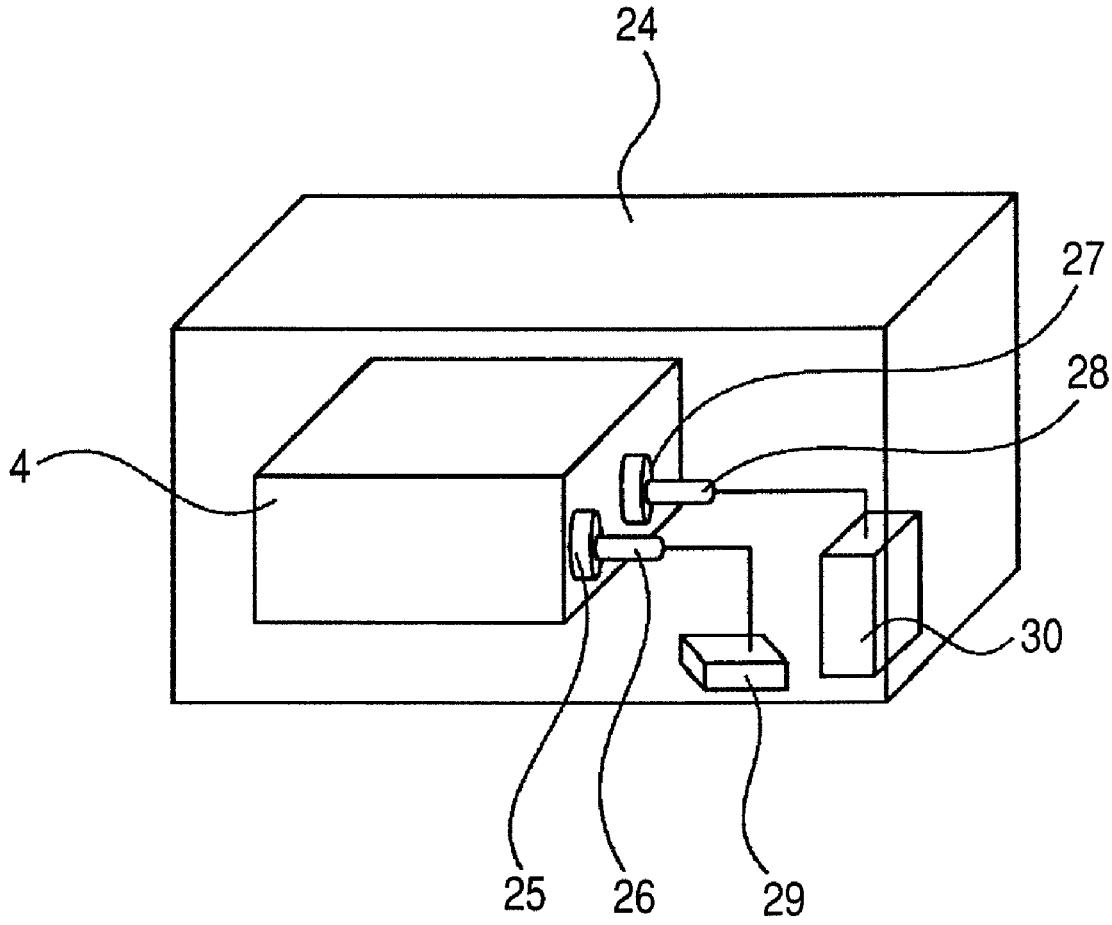
FIG. 6 is a block diagram illustrating the image forming apparatus and the developing apparatus.
Figure 7:
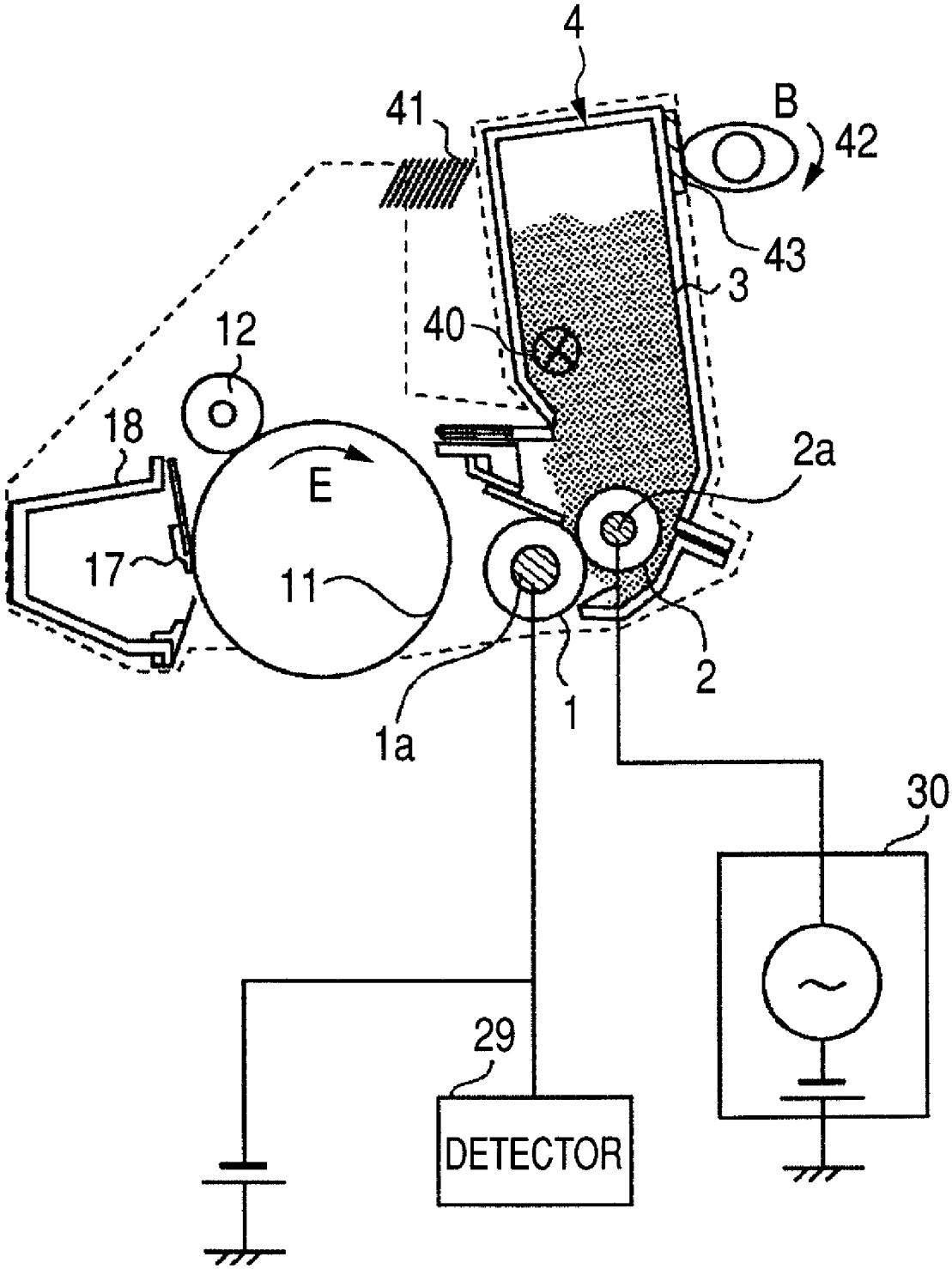
FIG. 7 is a block diagram illustrating a detector of an embodiment of the present invention.

With reference to FIGS. 6 and 7, a description is made of the toner remaining amount detecting method of the embodiments, in which the variation in capacitance is utilized.

FIG. 6 illustrates the state where the developing apparatus 4 of the embodiments is provided in the image forming apparatus 10, and illustrates a contact electrode 25 electrically connected to the cored electrode 1*a* of the developing roller 1 and attached to the developing apparatus. A contact electrode 26 corresponding to the contact electrode 25 is provided on the side of the main body of image forming apparatus 10, and is connected to a detector 29 serving as a capacitance detector provided in the main body of the image forming apparatus 10. Similarly, there are provided a contact electrode 27 electrically connected to the cored electrode 2*a* of the supplying roller 2 and attached to the developing apparatus, and a contact electrode 28 corresponding to the contact electrode 27 provided on the side of the main body of the image forming apparatus 10. The contact electrode 28 is connected to an alternating bias source 30 for detection provided in the main body of the image forming apparatus 10. As described above, the contact electrodes 25 and 27 are provided in the cartridge, and the contact electrodes 26 and 28 are provided on the main body of the image forming apparatus. In the state where the developing apparatus 4 is provided at a predetermined position in the image forming apparatus 10, and at both the first position where the developing roller 1 and the photosensitive drum 11 are brought into contact with each other and the second position where the developing roller 1 and the photosensitive drum 11 are separated from each other, the contact electrodes 25 and 26 are electrically connected with each other and the contact electrodes 27 and 28 are electrically connected with each other.

That is, even when the developing apparatus 4 rocks between the first position and the second position, the contact electrodes 25 and 26 remain in contact with each other and the contact electrodes 27 and 28 remain in contact with each other. At the normal developing operation, the developing apparatus is positioned at the first position, and the electrode 25 is applied with the developing bias (direct voltage) through the intermediation of the electrode 26. In this case, the electrode 27 is applied with the voltage as large as the developing bias through the intermediation of the electrode 28. That is, at the time of developing operation, the electrodes 25 and 27 are at the same potential, so the electrical field is not formed between the developing roller and the supplying roller. In this manner, during the developing operation, the power source for the capacitance detector 29 and the alternating bias source 30 is switched to the developing bias source (direct-current power source).

Next, as illustrated in FIG. 7, at the time of non-developing operation, the developing apparatus is positioned at the second position. In the embodiments, the conductive cored electrode 2*a* of the supplying roller 2 is applied with a bias for detecting toner remaining amount from the bias source 30 so as to perform the toner remaining amount detection for the developing apparatus 4. The bias for detecting toner remaining amount is an alternating bias having a frequency of 50 KHz and Vpp of 200 V.

In the cored electrode 1*a* of the developing roller 1, the voltage is induced by the bias for detecting toner remaining amount, the voltage being detected by the detector 29.

At the second position where the developing operation is not performed, that is, in the state where the photosensitive drum 11 and the developing roller 1 are separated from each other, the developing operation is not performed. Specifically, such cases are realized, for example, in the operation of the apparatus performed between sheets which have not been subjected to image formation, in the operation of the apparatus performed during which the recording media 15 is discharged outside the image forming apparatus after the completion of the image formation (so-called post-rotation), or the like. As a matter of course, the developing apparatus may be positioned at the second position during the pre-rotation operation of the photosensitive drum prior to the image formation.

In this case, since the photosensitive drum 11 and the developing roller 1 are separated from each other, at the second position, the taint on white ground called fog is not generated on the photosensitive drum 11 even when the alternating bias is applied as a bias for detecting toner remaining amount. Further, since the photosensitive drum 11 and the developing roller 1 are separated from each other, the unpleasant impact noises due to the vibration caused when the photosensitive drum and the developing roller hit each other in the middle of contact are not generated.

When the alternating bias to be used for the toner remaining amount detection is applied from the conductive cored electrode 2*a* of the supplying roller 2, and the developing roller 1 is used as an antenna for capacitance detection, it is possible to prevent the disturbance in feeding of the toner, which is caused in the structure where another dedicated antenna is provided in the developing chamber.

As illustrated in FIGS. 5B and 5C, from the contact operation to the separating operation of the photosensitive drum 11 and the developing roller 1, that is, from the first position where the developing operation is performed to the second position where the developing operation is not performed, the posture of the developing apparatus 4 is varied, so the toner is moved in accordance therewith.

In this case, in the developing apparatus 4 of the embodiments, the alternating bias is applied for the toner remaining amount detection from the conductive cored electrode 2*a* of the supplying roller 2, and the developing roller 1 is used as the antenna for capacitance detection. In this manner, the variation in capacitance of the toner contained in the supplying roller 2 is measured. Thus, the remaining amount of the toner contained in the supplying roller 2 is not varied even with the movement in the posture of the developing apparatus 4 and the movement of the toner T in association with the contact and separating operations, that is, the remaining amount of the toner present between the developing roller 1 and the antenna (supplying roller) is not varied even therewith. Therefore, the output of the voltage induced by the antenna is not varied. That is, since the supplying roller 2 includes the foam layer into which the toner gets, the toner contained in the foam layer is unlikely to move even with the variation in posture of the developing apparatus. As a result, the output of the voltage is not varied.

In addition, when the capacitance remaining amount detection is performed in the nonmagnetic mono-component developing apparatus 4 of the embodiments, that is, in the state where the developing roller 1 and the photosensitive drum 11 are separated from each other, the rotational drive of the developing roller 1 and the supplying roller 2 is stopped.

When the drive of the developing roller 1 and the supplying roller 2 is stopped, the toner supply to the developing roller 1 and the scraping of the undeveloped toner performed thereon are interrupted, so the amount of the toner contained in the supplying roller 2 is fixed in the middle of the toner remaining amount detection. As a result, it is possible to enhance the accuracy in the toner remaining amount detection.

Figure 8:
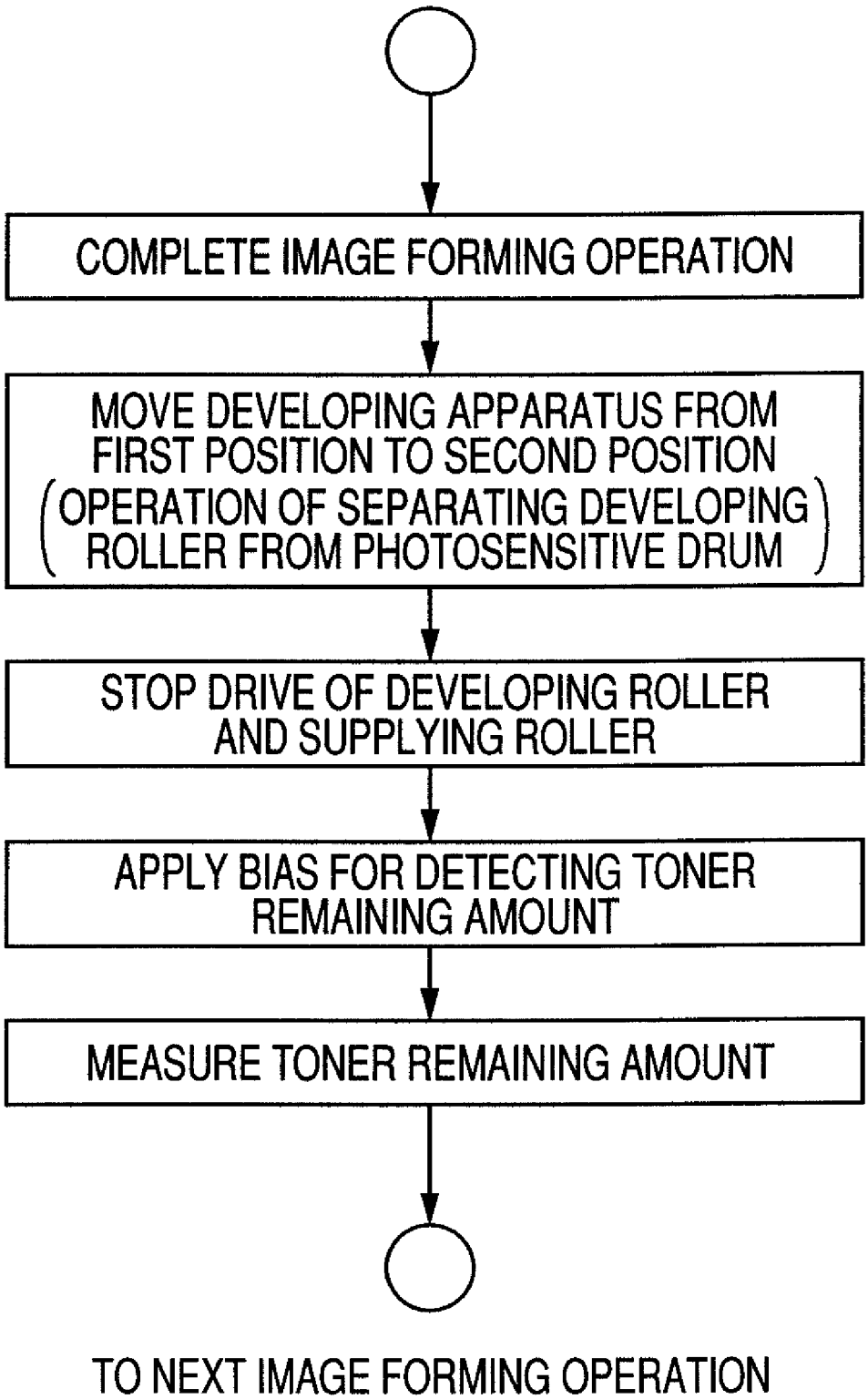
FIG. 8 is a flowchart illustrating a toner remaining amount detection of the embodiment of the present invention.

FIG. 8 is a flowchart illustrating a toner remaining amount detection of the embodiments. The toner remaining amount detection is performed at a timing as follows. After the completion of the image forming operation, the developing apparatus is moved from the first position to the second position, so the operation of separating the developing roller 1 from the photosensitive drum 11 is performed. Then, the drive of the developing roller 1 and the supplying roller 2 is stopped. After that, the bias for detecting toner remaining amount is applied so as to detect the toner remaining amount.

Figure 9:
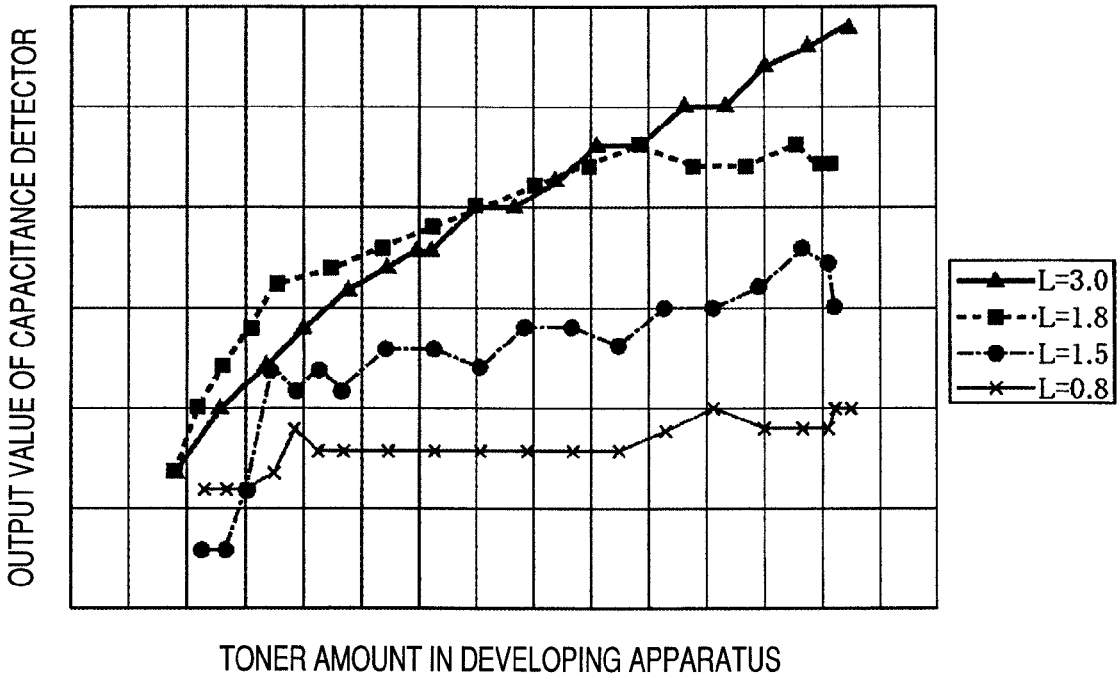
FIG. 9 is a graph showing a relationship between a toner remaining amount in the developing apparatus and an output of a capacitance detector.

FIG. 9 shows triangular points and a solid line indicating output values of the capacitance detector 29 in the case where the toner T is filled in the developing apparatus 4 of the embodiments to be gradually decreased. In the embodiments, a surface aeration amount L of the supplying roller is 3.0 (liter/min.). The measurement is performed under an environment of 23° C. and 60% Rh. As shown in FIG. 9, in the structure of the developing apparatus of the embodiments, the remaining amount of the toner T in the developing apparatus 4 and the output values of the capacitance detector 29 are varied in a good correlation as expressed by relatively linear lines. Regarding the indication of the toner amount, a reference value is set so as to be compared with the output values of the capacitance detector 29. The toner is determined to be depleted in the case where the output values are smaller than the reference value. When the toner is determined to be depleted, the warning message such as "Out of Toner" may be displayed on the display of the main body of the image forming apparatus, on the computer connected to the image forming apparatus, and the like, or the image forming operation in the image forming apparatus may be interrupted. Further, in the case where a detachable process cartridge is used in the main body of the image forming apparatus, the replacement timing of the cartridge may be notified by the main body of the image forming apparatus. Further, as illustrated in FIG. 9, since the toner remaining amount and the output values of the capacitance detector 29 are correlated with each other, it is possible to display the warning message such as "A Little Toner" at a timing the remaining amount of the toner T in the developing apparatus 4 reaches a desired amount. Further, when multiple reference values are set, it is possible to display multiple warning messages in the pieces of information about the toner remaining amount. For example, it suffices that the present remaining amount of the toner being used is displayed stepwise in percent figures while the amount of the brand-new toner contained in the developing container is regarded as 100%.

A comparison was made between the toner amount and the output values of the first embodiment of the present invention (in which surface aeration amount of supplying roller is 3.0 (liter/min.)) after changing the foam ratio of the foam layer of the supplying roller and preparing some supplying rollers of the embodiments which are different in surface aeration amount from one another, the supplying rollers being incorporated into the developing apparatus having the same structure as that of the first embodiment of the present invention.

As a second embodiment of the present invention, FIG. 8 illustrates quadrangular points and a broken line indicating the output values obtained by the measurement performed under the same condition in a developing apparatus in which the supplying roller having the urethane foam layer of the surface aeration amount of 1.8 (liter/min.) is used.

As a first comparative example, FIG. 9 shows circular points and an alternate long and short dash line indicating the output values obtained by the measurement performed under the same condition in a developing apparatus in which the supplying roller having the urethane foam layer of the surface aeration amount of 1.5 (liter/min.) is used.

As a second comparative example, FIG. 9 shows×points and a thin continuous line indicating the output values obtained by the measurement performed under the same condition in a developing apparatus in which the supplying roller having a urethane foam layer of the surface aeration amount of 0.8 (liter/min.) is used.

A comparison made between the first and second embodiments and the first and second comparative examples clarifies the following. The variation in output values cannot be found in the first and second comparative examples until the toner T is consumed by half from the initial use state, and the output values are not varied until the large amount of toner T is consumed.

Figure 10:
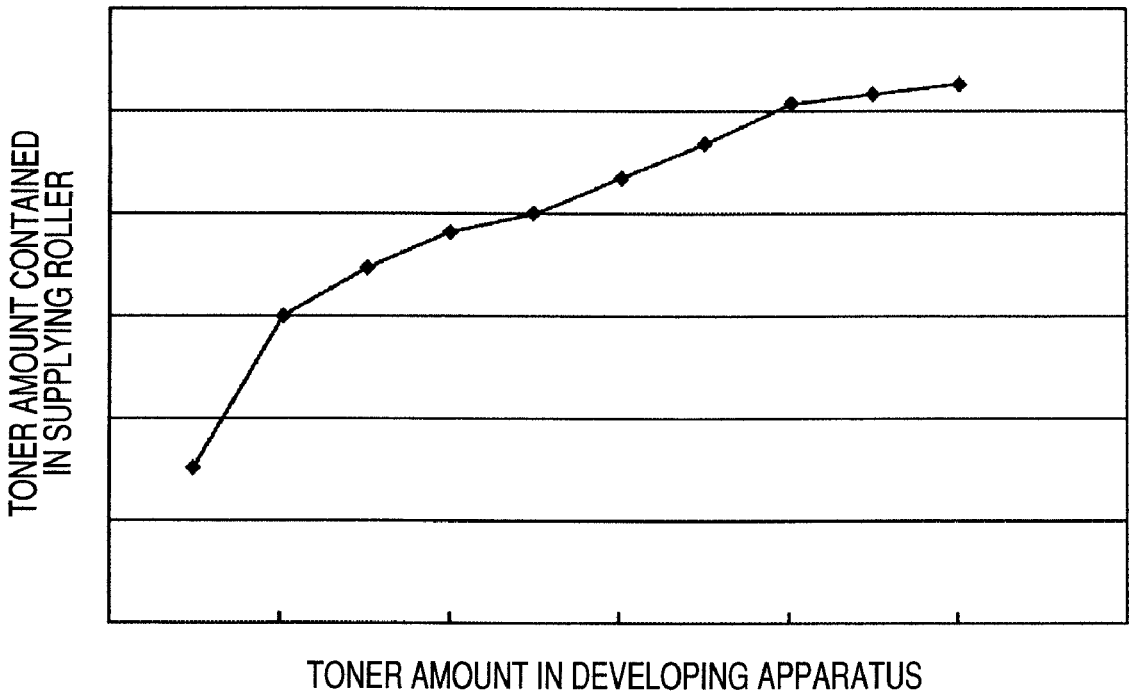
FIG. 10 is a graph showing a relationship between the toner remaining amount in the developing apparatus and an amount of the toner contained in a supplying roller.

FIG. 10 shows plots indicating the remaining amount of the toner T in the developing apparatus 4 of the first embodiment, and the amount of the toner contained in the supplying roller 2 in this case. FIG. 10 illustrates the results obtained by the measurement of the amount of the toner T contained in the supplying roller 2 which was taken out after the measurements of the capacitance performed at different toner remaining amounts, the toner T having been consumed under the same condition as that in the measurements of which the results are shown in FIG. 9. (Difference in weight of supplying roller 2 between unused state and used state was calculated.) FIG. 10 proves that the toner remaining amount in the developing apparatus and the amount of the toner contained in the supplying roller are varied while maintaining a good correlation as expressed by a relatively linear line. That is, it is found that the toner amount in the developing container can be accurately determined by the measurement of the capacitance performed by using the detector 29.

Note that, the aeration amount of the supplying roller disclosed in Japanese Patent Application Laid-Open No. H11-288161, which is described in the related example, was determined to be 0.3 to 1.3 (liter/min.). Further, in the toner remaining amount detector as disclosed in Japanese Patent Application Laid-Open No. H04-234777, the supplying member formed of the urethane sponge was used which is described in Japanese Patent Application Laid-Open No. H11-288161. Then, the toner remaining amount detecting method in which the variation in capacitance was utilized was adopted thereto. When only the measurement of the toner amount was performed by using the detector, it was difficult to accurately detect the toner amount because the variation in outputs of the detector was unstable when the sufficient amount of toner remained in the toner container. Further, it was difficult to perform the detection until the toner remaining amount was decreased, and the image defects called light density were generated in some cases owing to lack of toner.

Figure 11:
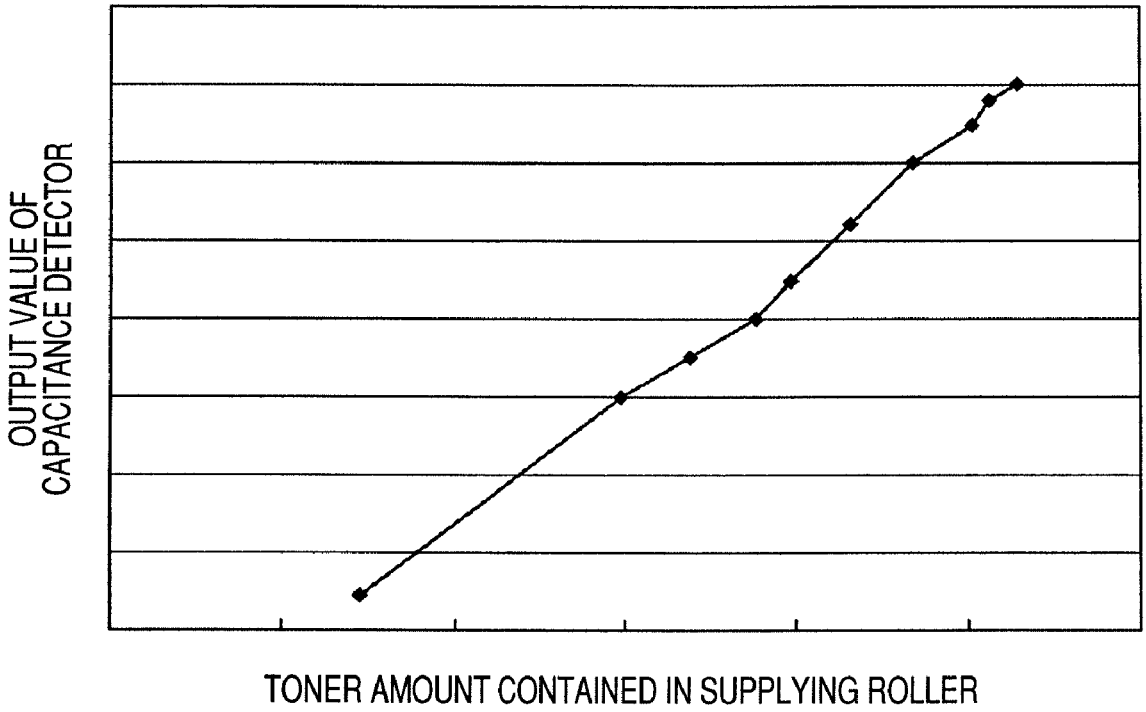
FIG. 11 is a graph showing a relationship between the amount of the toner contained in the supplying roller and the output of the capacitance detector.

As a result of the measurement of the embodiments, plots shown in FIG. 11 were obtained which indicate the capacitance output values of the developing apparatus 4 of the first embodiment and the amounts of the toner contained in the supplying roller 2 corresponding thereto. FIG. 11 shows that the capacitance output values of the developing apparatus and the amounts of the toner contained in the supplying roller are correlated while maintaining a significantly good correlation as expressed by a substantially linear line. This proves that it is possible to appropriately measure the variation in capacitance in the supplying roller 2 with the structure of the embodiments. That is, FIGS. 10 and 11 show that, with the measurement of the capacitance performed by using the detector 29, it is possible to accurately determine the amount of the toner contained in the supplying roller and the amount of the toner contained in the developing container.

Figure 12:
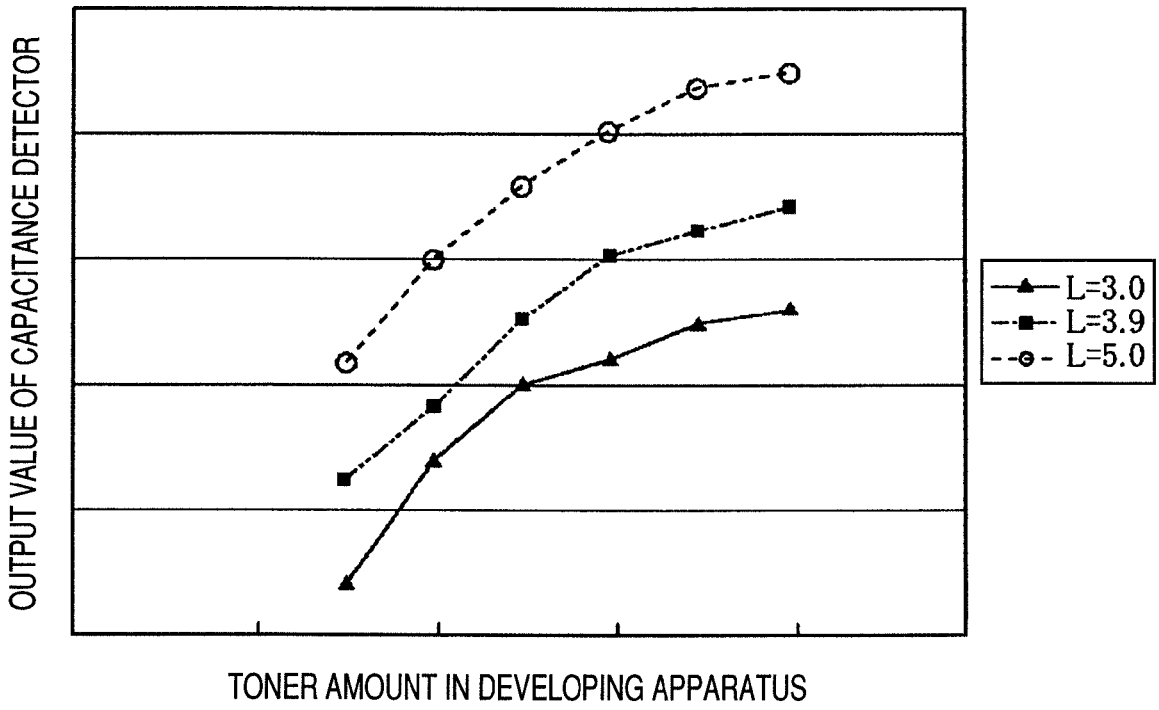
FIG. 12 is a graph showing a relationship between the toner remaining amount in the developing apparatus and the output of the capacitance detector.

Further, after preparation of some supplying rollers each having an aeration amount larger than that of the supplying roller of the first embodiment, a comparison was made between the output results obtained by using the developing apparatus having the same structure as that of the developing apparatus of the first embodiment and the output results of the first embodiment. The results thus obtained are shown in FIG. 12. The output results of the first embodiment are indicated by the triangular points and the solid line. As a third embodiment, FIG. 12 shows quadrangular points and a broken line indicating the output values obtained by the measurement performed under the same condition in a developing apparatus in which the supplying roller having the urethane foam layer of the surface aeration amount of 3.9 (liter/min.) is used. Further, as a fourth embodiment, FIG. 12 shows circular points and an alternate long and two short dashes line indicating the output values obtained by the measurement performed under the same condition in a developing apparatus in which the supplying roller having the urethane foam layer of the surface aeration amount of 5.0 (liter/min.) is used.

As shown in FIG. 12, absolute values of the output values of the capacitance detector were increased in proportion to an increase in aeration amount. However, the variation amounts according to the toner amount in the developing apparatus were the same among the supplying rollers 2 having aeration amount of 3 to 5 (liter/min.). In other words, in the supplying roller having an aeration amount of 1.8 (liter/min.) or larger, the output values of the capacitance to be detected and the toner amount in the developing container are correlated well with each other, so the accuracy in toner remaining amount detection is enhanced. Further, when the aeration amount is large, the strength of the supplying roller is decreased owing to an increase in the cell portions of the foam layer of the supplying roller. As a result, the foam layer of the supplying roller is liable to suffer breakage. In order to prevent the breakage, it would be better to set the aeration amount to 5.0 (liter/min.) or less. Especially, it would be better to set the aeration amount L to satisfy $3.0<L<5.0$.

As described above, with the appropriate setting of the aeration amount of the supplying roller, the amount of the toner contained in the supplying roller is increased, the amount of the toner contained in the supplying roller being decreased accordingly to a decrease in amount of the toner contained in the developing container (refer to FIG. 10). Further, the output values of the capacitance between the developing roller and the supplying roller are decreased accordingly to a decrease in amount of the toner in the supplying roller (refer to FIG. 11). Thus, in the determination of the amount of the toner contained in the developing container, it is effective to measure the output values of the capacitance between the developing roller and the supplying roller (refer to FIG. 12). In order to increase the amount of the toner contained in the supplying roller, it would be better to set the average diameter of the cell formed in the surface of the foam layer of the supplying roller to be larger than the average particle diameter (weight average particle diameter, for example) of the toner.

Note that, a part of the toner is discharged from the supplying roller at the start of deformation which is caused when the supplying roller starts to come into contact with the developing roller, and is absorbed in the supplying roller at the restoration from the deformation, which is caused when the supplying roller is brought out of contact with the developing roller. In this manner, the toner gets into and out of the supplying roller. The amount of the toner in the supplying roller is maintained in a substantially equilibrium state as long as the amount of the toner in the developing container remains unchanged. In order to measure with accuracy the output values of the capacitance for more accurate determination of the amount of the toner in the supplying roller, it would be better to stop, as described above, the rotation of the supplying roller so that the toner is not allowed to get in and out of the supplying roller.

The correlation between the remaining amount of the toner in the developing apparatus and the amount of the toner contained in the supplying roller, which is shown in FIG. 10, is varied accordingly also to the degree of compaction of the toner T. It is probable that the toner gets into and out of the supplying roller more easily with lower degree of compaction, so the correlation between the remaining amount of the toner in the developing apparatus and the amount of the toner contained in the supplying roller is improved. In the image forming apparatus 10 of the embodiments, the image forming operation was performed to measure the degree of compaction of the toner T remaining in the developing container after the toner T in the developing apparatus is sufficiently consumed. The degree of compaction was measured to be 30%. Generally, the degree of compaction of the toner T tends to become higher accordingly to the larger consumption of the toner T in the developing container. Thus, it is assumed that the degree of compaction of the toner T in the developing apparatus prior to the image forming operation is lower than 30%.

In other words, the toner having a degree of compaction of lower than 30% can be used without any problems in achieving the condition where the toner gets into and out of the supplying roller in an equilibrium manner, which is the feature of the present invention.

The amount of the toner contained in the supplying roller and the amount of the toner in the toner container are correlated with each other. Therefore, the correlation, which is shown in FIG. 10, between the remaining amount of the toner in the developing apparatus and the amount of the toner contained in the supplying roller is high to the extent that the dead weight of the toner in the toner container is directly applied to the supplying roller. Thus, as in the embodiments, it is possible to enhance the accuracy in toner remaining amount detection with the structure in which the supplying roller is arranged at the opening portion of the toner container.

The image forming apparatus 10 of the embodiments has a structure in which the bias for detecting toner remaining amount is applied to the supplying roller 2 and the detector for detecting the voltage induced in the developing roller 1. However, it is possible to obtain the same effect even with the structure in which the bias for detecting toner remaining amount is applied to the developing roller 1 and the detector for detecting the voltage induced in the supplying roller 2.

Other Embodiments

With reference to another drawing, the developing apparatus of another suitable embodiment is described. Note that, the components and operations described in the following embodiment are the same as those in the first embodiment, so the same reference numerals are given thereto and the description thereof is omitted.

Figure 13:
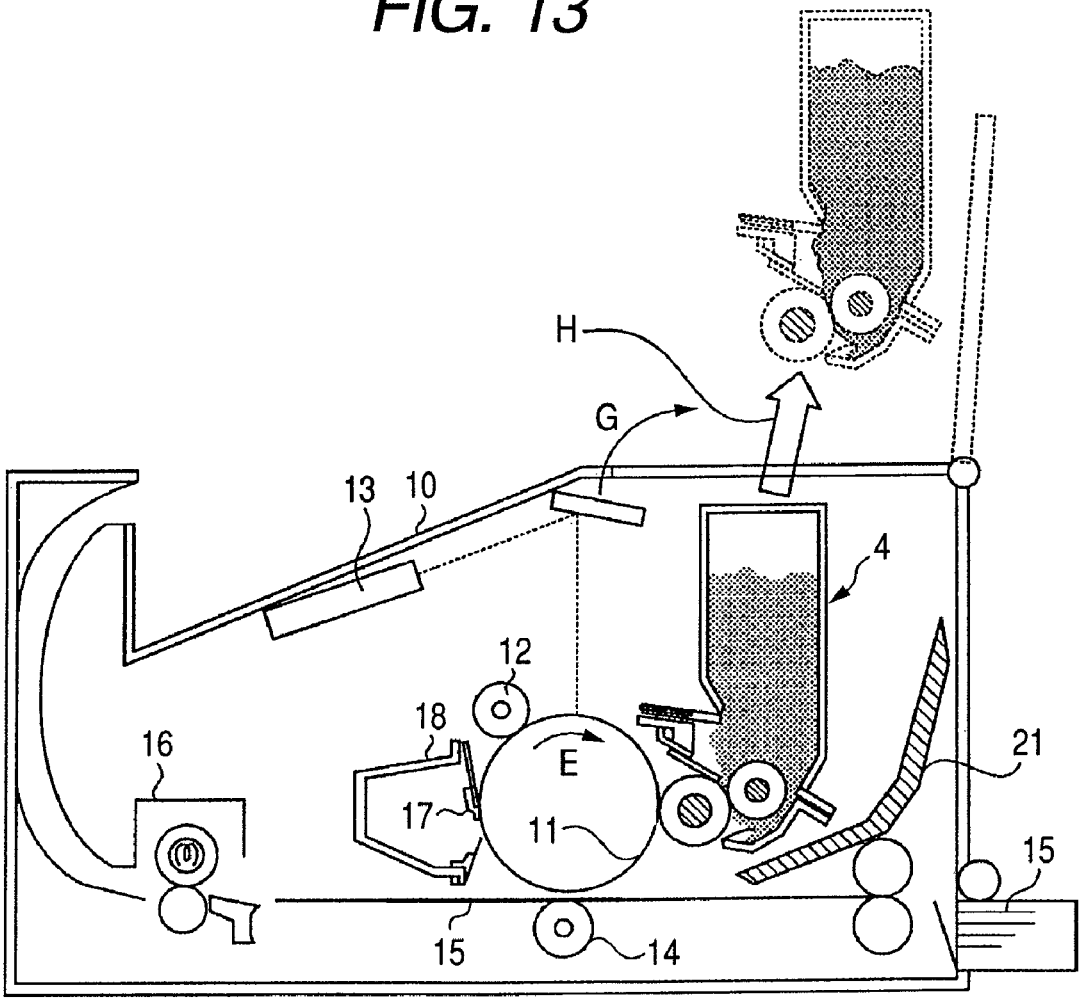
FIG. 13 is a schematic cross-sectional view illustrating the image forming apparatus including the developing apparatus according to the present invention.
Figure 14:
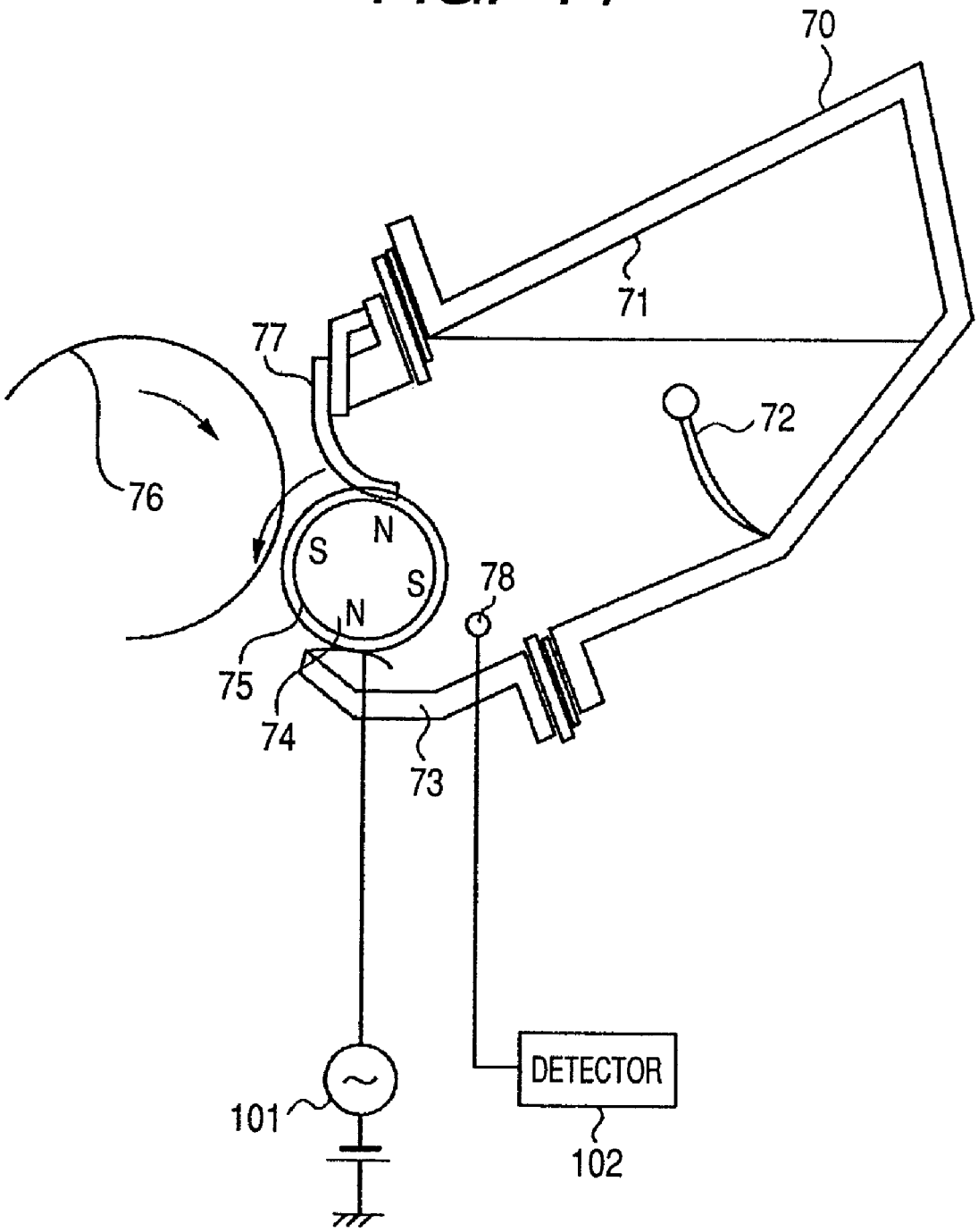
FIG. 14 is a schematic structural view of a related developing apparatus.
Figure 15:
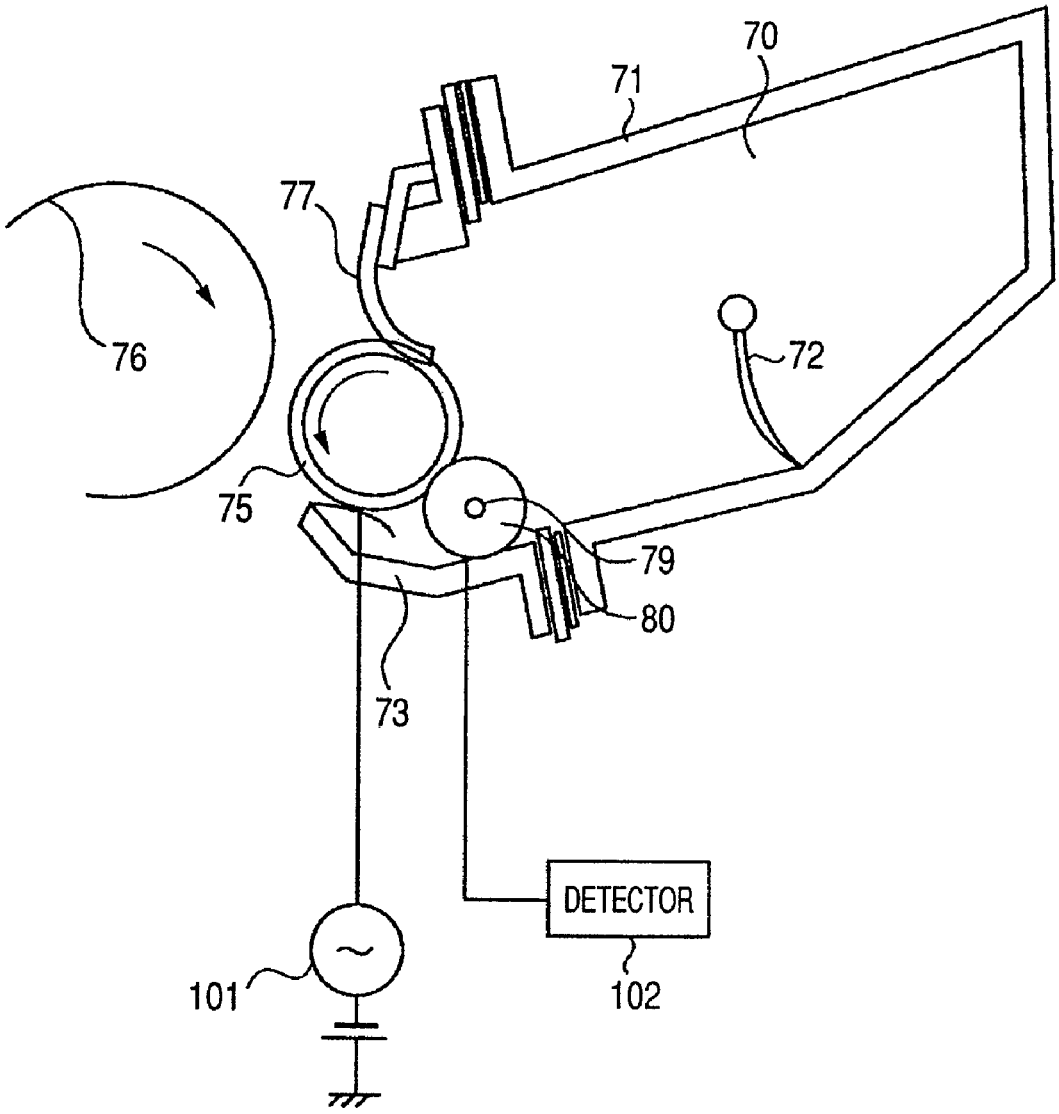
FIG. 15 is a schematic structural view of another related developing apparatus.

FIG. 13 is a schematic cross-sectional view illustrating the another embodiment of the image forming apparatus according to the present invention.

The developing cartridge of FIG. 13, which is constituted by the developing apparatus 4, is detachable to the main body of the image forming apparatus by being drawn out by a user in the direction indicated by the arrow H of FIG. 13 along the guide 21 provided in the image forming apparatus after the openable window provided on the upper portion of the image forming apparatus is opened in the direction indicated by the arrow G of FIG. 13.

Even in the developing apparatus structured as described above, it is possible to adopt the component portion of the developing apparatus of the process cartridge described in the first embodiment, and the same effect as that in the first embodiment can be obtained. That is, the cartridge detachable to the main body of the image forming apparatus may be the developing cartridge described in this embodiment or the process cartridge described in the first embodiment, which includes the photosensitive drum.

According to the present invention, with the application of the developer supplying member for supplying the developer to the developer carrying member for detecting the capacitance in the developing container, the necessity for providing an antenna dedicated to detecting the capacitance in the developing container is eliminated, which leads to advantages in space and cost. Further, it is possible to perform the stable and accurate detection without disturbing the feeding of the toner, thereby enhancing the accuracy in detection of the amount of the developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-172290, filed Jun. 29, 2007 which is hereby incorporated by reference herein in its entirety.

What is claimed is:

1. An image forming apparatus comprising:

a developing apparatus for developing an electrostatic latent image formed on an image bearing member with a developer, the developing apparatus including a developer carrying member for carrying the developer to develop the electrostatic latent image with the developer and a developer supplying member having a foam layer into which the developer can enter for supplying the developer to the developer carrying member, the developer carrying member having a core electrode for rotatably supporting the developer carrying member, and the developer supplying member having a core electrode for rotatably supporting the developer supplying member; and a detector for detecting information relating to capacitance between the core electrode of the developer carrying member and the core electrode of the developer supplying member by detecting a voltage induced from the core electrode of the developer carrying member when the alternating bias is applied to the core electrode of the developer supplying member, wherein a surface aeration amount L (liter/minute) of the developer supplying member satisfies $1.8 \leqq L$ when the surface aeration amount L is measured by:

(i) inserting the developer supplying member into a measurement jig including a hollow cylinder having an inner diameter smaller by 1 mm than an outer diameter of the developer supplying member, and two through-holes each having a diameter of 10 mm in a side surface of the hollow cylinder, one through-hole being exposed to ambient air and the other through-hole being communicated with a flowmeter and a decompression pump, and (ii) measuring a value of the flowmeter when the decompression pump evacuates air from the measurement device under the same exhaust condition as an exhaust condition in which a value of the flowmeter is 10.8 liters/minute in a state in which the developer supplying member is not inserted into the hollow cylinder.

2. An image forming apparatus according to claim 1, wherein the surface aeration amount L of the developer supplying member satisfies $L \leqq 5.0$.

3. An image forming apparatus according to claim 1, wherein the foam layer is made of open-cell foam.

4. An image forming apparatus according to claim 1, wherein the developer supplying member is provided in contact with the developer carrying member.

5. An image forming apparatus according to claim 1, further comprising a developer regulating member provided in contact with the developer carrying member for regulating the developer carried on the developer carrying member.

6. An image forming apparatus according to claim 1, wherein an average diameter of cells formed in a surface of the foam layer of the developer supplying member is larger than a weight average particle diameter of the developer.

7. An image forming apparatus according to claim 1, wherein a degree of compaction of the developer is lower than 30%.

8. An image forming apparatus according to claim 1, wherein the information relating to capacitance is compared with multiple reference values.

9. An image forming apparatus according to claim 1, wherein the developing apparatus has a vertical length longer than a horizontal length in a cross section perpendicular to an axis of the developer supplying member, and wherein the developer supplying member is provided in a vicinity of a bottom of the developing apparatus.

* * * * *